US011361691B2

(12) United States Patent
Qiu et al.

(10) Patent No.: US 11,361,691 B2
(45) Date of Patent: Jun. 14, 2022

(54) DRIVE CIRCUIT AND DISPLAY DEVICE

(71) Applicants: CHONGQING HKC OPTOELECTRONICS TECHNOLOGY CO., LTD., Chongqing (CN); HKC Corporation Limited, Guangdong (CN)

(72) Inventors: Bin Qiu, Chongqing (CN); Lidan Ye, Shenzhen (TW)

(73) Assignees: CHONGQING HKC OPTOELECTRONICS TECHNOTOGY CO., LTD., Chongqing (CN); HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/326,037

(22) Filed: May 20, 2021

(65) Prior Publication Data

US 2022/0028309 A1 Jan. 27, 2022

(30) Foreign Application Priority Data

Jul. 27, 2020 (CN) ..... 202010731393.9

(51) Int. Cl.
*G09G 3/34* (2006.01)
*G09G 3/00* (2006.01)

(52) U.S. Cl.
CPC ..... *G09G 3/006* (2013.01); *G09G 2320/041* (2013.01); *G09G 2330/021* (2013.01)

(58) Field of Classification Search
CPC ..... G09G 3/006; G09G 2330/021; G09G 2320/041
See application file for complete search history.

(56) References Cited

U.S. PATENT DOCUMENTS 4,125,107 A * 11/1978 Nurnberg ..... F24S 50/40 126/587
4,494,526 A * 1/1985 Wurst ..... G05D 23/24 126/585
4,922,139 A * 5/1990 Giebel ..... H03L 7/0895 327/2
5,501,517 A * 3/1996 Kiuchi ..... G01R 19/32 361/100
5,869,878 A * 2/1999 Hasegawa ..... H01L 23/34 257/467
6,342,997 B1 * 1/2002 Khadkikar ..... G01K 3/005 361/100

(Continued)

*Primary Examiner* — Jose R Soto Lopez

(57) ABSTRACT

A drive circuit and a display device are provided. A detection diode is included in a drive chip of the drive circuit. An acquisition circuit may acquire an electrical signal related to a voltage across the detection diode and a current flowing through the detection diode. A detection circuit may obtain an internal temperature of the drive chip based on the electrical signal acquired by the acquisition circuit. A control circuit may control the drive chip based on the internal temperature of the drive chip obtained by the detection circuit. When the detecting circuit detects that the internal temperature of the drive chip is greater than a maximum threshold temperature or less than a minimum threshold temperature, the acquisition circuit controls the drive chip to stop outputting a drive signal.

18 Claims, 2 Drawing Sheets

(56) References Cited

U.S. PATENT DOCUMENTS 8,687,026 B2 * 4/2014 Wurzel ..... G09G 3/3677 345/690
9,300,198 B2 * 3/2016 Nakamori ..... H02M 1/32
9,867,253 B2 * 1/2018 Dunn ..... H05B 47/11
2002/0140447 A1 * 10/2002 Throngnumchai ..... G01K 7/42 374/178
2004/0222430 A1 * 11/2004 Necco ..... G01K 7/01 257/90
2005/0110420 A1 * 5/2005 Arnold ..... G09G 3/3225 315/169.3
2005/0122305 A1 * 6/2005 Murao ..... G02F 1/133382 345/101
2005/0231169 A1 * 10/2005 Seo ..... H01M 10/486 320/150
2005/0242747 A1 * 11/2005 Kato ..... G09G 3/3225 315/169.3
2006/0238186 A1 * 10/2006 Nishikawa ..... G01K 7/01 324/71.1
2006/0255361 A1 * 11/2006 Oyabe ..... H01L 29/7395 257/139
2007/0058437 A1 * 3/2007 Schaffer ..... G11C 5/143 365/185.23
2007/0216468 A1 * 9/2007 Duarte ..... G01K 7/01 327/513
2007/0216671 A1 * 9/2007 Oku ..... G09G 3/367 345/211
2007/0221994 A1 * 9/2007 Ishikawa ..... H01L 27/0248 257/356
2007/0274016 A1 * 11/2007 Thiele ..... H03K 17/6877 361/103
2008/0031304 A1 * 2/2008 Nishimura ..... G01K 7/015 374/178
2008/0100978 A1 * 5/2008 Maebara ..... H03K 17/0828 361/93.8
2008/0143652 A1 * 6/2008 Hasegawa ..... G09G 3/3233 345/77
2008/0192391 A1 * 8/2008 Inoue ..... G05F 1/56 361/18
2008/0231621 A1 * 9/2008 Chang ..... G09G 3/342 345/211
2008/0266216 A1 * 10/2008 Choi ..... G09G 3/3258 345/77
2008/0284714 A1 * 11/2008 Wu ..... G09G 3/3413 345/102
2008/0309608 A1 * 12/2008 Shen ..... G09G 3/3696 345/101
2008/0317086 A1 * 12/2008 Santos ..... G01K 15/00 374/1
2010/0086991 A1 * 4/2010 Fish ..... B01L 7/52 435/286.1
2010/0097354 A1 * 4/2010 Ahn ..... G06F 3/0412 345/175
2010/0283530 A1 * 11/2010 Zimlich ..... G05F 3/30 327/513
2011/0032001 A1 * 2/2011 Hasegawa ..... G01K 7/01 327/1
2011/0316823 A1 * 12/2011 Otani ..... G09G 3/3688 345/204
2012/0182450 A1 * 7/2012 Sato ..... H04N 5/3575 348/241
2012/0188287 A1 * 7/2012 Wurzel ..... G06F 1/203 345/690
2012/0229494 A1 * 9/2012 Kobayashi ..... H04N 13/341 345/589
2013/0033198 A1 * 2/2013 Kang ..... H05B 47/28 315/309
2013/0051428 A1 * 2/2013 Wang ..... G01K 7/015 374/152
2013/0060499 A1 * 3/2013 Yoshimura ..... G01K 15/005 702/99
2013/0121377 A1 * 5/2013 Furuichi ..... G01K 7/01 374/178
2013/0214823 A1 * 8/2013 Kawamoto ..... H02H 9/025 327/109
2013/0235689 A1 * 9/2013 Koyama ..... H01L 27/1203 365/227
2013/0293186 A1 * 11/2013 Chou ..... H02J 7/007194 320/107
2014/0111499 A1 * 4/2014 Jang ..... H01L 31/068 345/212
2014/0375620 A1 * 12/2014 Chen ..... G09G 3/20 345/212
2015/0223304 A1 * 8/2015 Li ..... H05B 47/24 315/118
2015/0255018 A1 * 9/2015 Aoki ..... G09G 3/20 345/76
2016/0104450 A1 * 4/2016 Lee ..... G09G 3/3688 345/211
2016/0116345 A1 * 4/2016 Furtner ..... G01K 7/01 374/178
2016/0349118 A1 * 12/2016 Olson ..... G01K 7/015
2017/0053588 A1 * 2/2017 Lim ..... G09G 3/3275
2017/0077919 A1 * 3/2017 Nakamori ..... H02M 7/48
2017/0263194 A1 * 9/2017 Kang ..... G09G 3/342
2017/0307450 A1 * 10/2017 Kim ..... H03K 17/0828
2018/0076801 A1 * 3/2018 Okada ..... G09G 3/2096
2019/0226919 A1 * 7/2019 Ohashi ..... G01K 7/25
2019/0310140 A1 * 10/2019 Mori ..... H03K 5/24
2020/0194994 A1 * 6/2020 Goto ..... H02H 7/205
2020/0241379 A1 * 7/2020 Barnum ..... H02J 7/0049
2020/0350904 A1 * 11/2020 Melkonyan ..... H03K 17/0822
2021/0104186 A1 * 4/2021 Fujikawa ..... G02F 1/136204

* cited by examiner

DRIVE CIRCUIT AND DISPLAY DEVICE

CROSS REFERENCE TO RELATED APPLICATIONS

This application claims priority to Chinese Patent Application No. 2020107313939, filed on Jul. 27, 2020, which is incorporated herein by reference in its entirety.

TECHNICAL FIELD

The present application relates to a field of display technology, and more particularly, to a drive circuit and a display device.

BACKGROUND

With the development of display technology nowadays, various drive chips in a drive circuit are getting smaller while their functions are increasing. Therefore, the protection mechanism for the circuit increases. Currently, most protection mechanisms are directed to the voltage or current of the drive chip itself. When the voltage or current of the drive chip itself exceeds a nominal value, an operation is stopped.

However, at present, there are very few protection mechanisms for the temperature of the drive chip. As a result, when the temperature of the drive chip is abnormal due to internal failure or external high temperature, the drive chip may be damaged or burned.

SUMMARY

Based on the above, in view of the above technical problem, it is necessary to provide a drive circuit and a display device that can protect the drive chip when the temperature of the drive chip is abnormal.

A drive circuit is provided, including: a drive chip, configured to provide a drive signal, including a detection diode; a power supply circuit, configured to provide a constant power supply for the detection diode; an acquisition circuit, configured to acquire an electrical signal related to a voltage across the detection diode and a current flowing through the detection diode; a detection circuit, configured to obtain the voltage across the detection diode and the current flowing through the detection diode based on the electrical signal acquired by the acquisition circuit, and obtain an internal temperature of the drive chip based on the voltage across the detection diode and the current flowing through the detection diode; and a control circuit, configured to control the drive chip based on the internal temperature of the drive chip obtained by the detection circuit. When the detection circuit detects that the internal temperature of the drive chip is greater than a maximum threshold temperature or less than a minimum threshold temperature, the control circuit controls the drive chip to stop outputting the drive signal.

A drive circuit is further provided, including: a drive chip, configured to provide a drive signal, including a detection diode; a power supply circuit, configured to provide a constant power supply for the detection diode; a detection resistor, having a constant resistance value and being connected in series with the detection diode; an acquisition circuit, including a first acquisition sub-circuit and a second acquisition sub-circuit, the first acquisition sub-circuit being configured to acquire and output a voltage across the detection diode, and the second acquisition sub-circuit being configured to acquire and output a voltage across the detection resistor; a timing controller, including a detection circuit and a control circuit, wherein the detection circuit is configured to calculate a current flowing through the detection diode based on the voltage across the detection resistor, and to obtain an internal temperature of the drive chip based on the voltage across the detection diode and the current flowing through the detection diode; and a control circuit, configured to control the drive chip based on an internal temperature of the drive chip obtained by the detection circuit; when the detection circuit detects that the internal temperature of the drive chip is greater than a maximum threshold temperature or less than a minimum threshold temperature, the control circuit controls the drive chip to stop outputting the drive signal.

A display device is further provided, including a display panel, and the drive circuit mentioned above, and the drive circuit is configured to drive the display panel.

According to the above drive circuit, a detection diode is included in the drive chip. The acquisition circuit may acquire an electrical signal related to a voltage across the detection diode and a current flowing through the detection diode. The detection circuit may obtain the voltage across the detection diode and the current flowing through the detection diode based on the electrical signal acquired by the acquisition circuit, and may obtain the internal temperature of the drive chip based on the voltage across the detection diode and the current flowing through the detection diode. The control circuit may control the drive chip based on the internal temperature of the drive chip obtained by the detection circuit. When the detection circuit detects that the internal temperature of the drive chip is greater than the maximum threshold temperature or less than the minimum threshold temperature, the control circuit controls the drive chip to stop outputting the drive signal. Therefore, the drive chip of the drive circuit of the present application outputs the drive signal only when the temperature is normal, and thus, the drive chip can be effectively protected to prevent the drive chip from being damaged or burned due to a temperature abnormality.

DETAILED DESCRIPTION

In order to make the objectives, technical solutions and advantages of the present application more clear, the present application will be further described in detail below with reference to the accompanying drawings and embodiments. It should be understood that the specific embodiments described herein are merely intended to explain the present application and are not intended to limit the present application.

The display device provided in the present application may be a liquid crystal display device, or may also be an organic light emitting display device, or may also be another type of display device.

Figure 1:
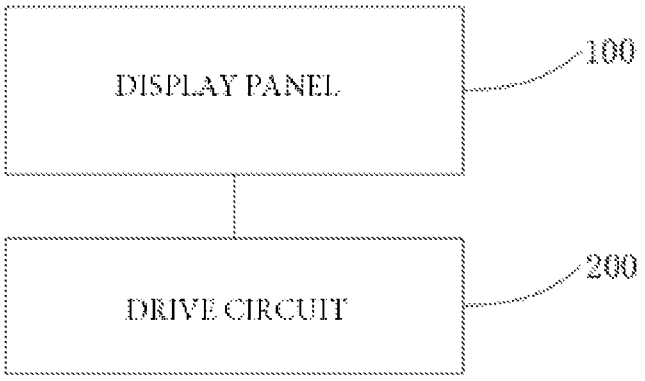
FIG. 1 is a schematic diagram of a display device according to an embodiment.
Figure 2:
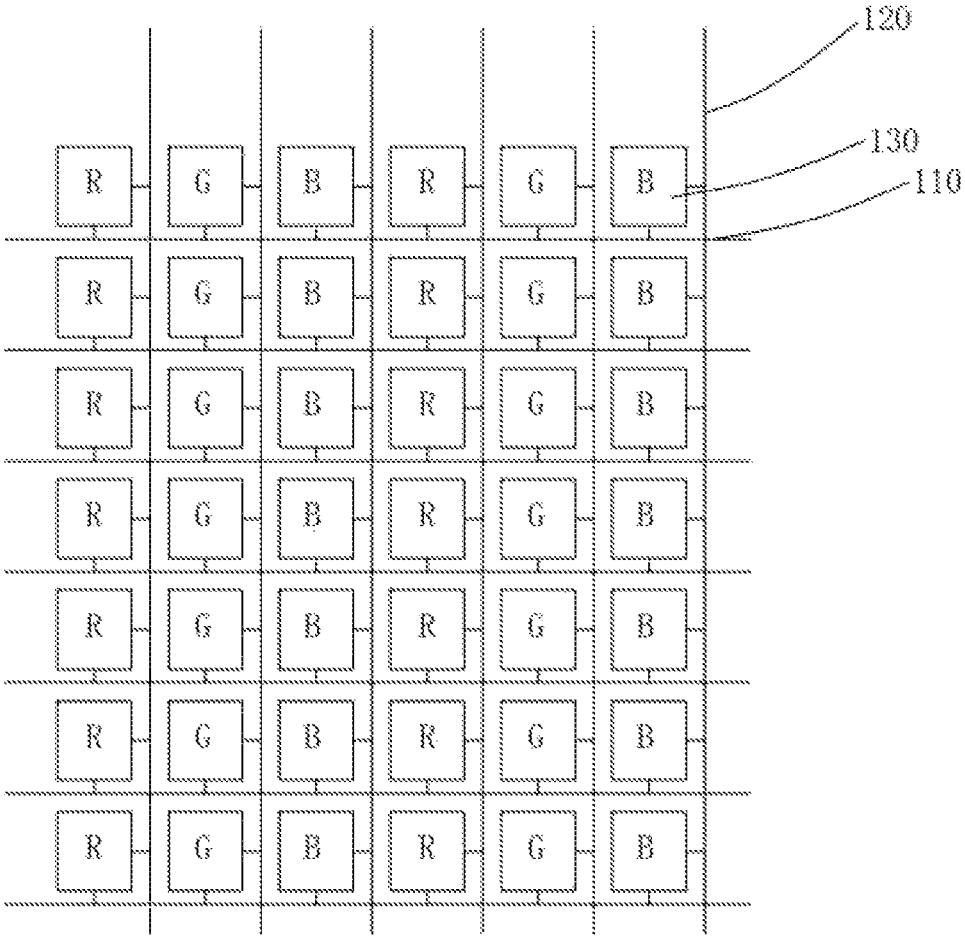
FIG. 2 is a schematic diagram of a display panel according to an embodiment.

In an embodiment, referring to FIG. 1, a display device is provided. The display device includes a display panel 100 and a drive circuit 200. Referring to FIG. 2, the display panel 100 includes a plurality of scan lines 110, a plurality of data lines 120, and the like. The plurality of scanning lines 110 are arranged to intersect with the plurality of data lines 120, and thus define a plurality of sub-pixels 130 (for example, a red sub-pixel R, a green sub-pixel G, and a blue sub-pixel B or the like) of different colors.

Figure 3:
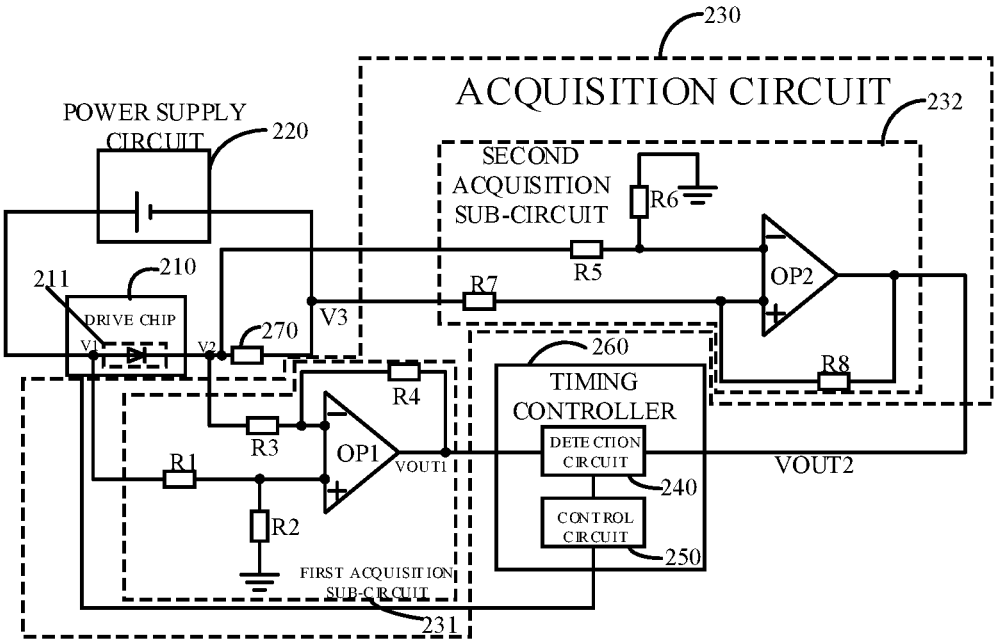
FIG. 3 is a schematic diagram of a drive circuit according to an embodiment.

Referring to FIG. 3, the drive circuit 200 is configured to drive the display panel 100, and includes a drive chip 210, a power supply circuit 220, an acquisition circuit 230, a detection circuit 240 and a control circuit 250. In addition, the drive circuit 200 may further include a timing controller 260. The timing controller 260 is configured to control an output timing of the drive signal output from the drive chip 210.

The drive chip 210 may be a gate driver, or may be a data driver, or may include both a gate driver and a data driver. Alternatively, the drive chip may also be or include other chips in the drive circuit 200, which is not limited in the present application.

The drive chip 210 includes a detection diode 211. The power supply circuit 220 provides a constant power supply for the detection diode 211. The acquisition circuit 230 is configured to acquire an electrical signal related to a voltage across the detection diode 211 and a current flowing through the detection diode 211 when the power supply voltage is constant.

The detection circuit 240 may obtain the voltage across the detection diode 211 and the current flowing through the detection diode 211 based on the electrical signal acquired by the acquisition circuit 230. The detection diode 211 has sensitivity to the temperature in the environment in which it is located. When the temperature is increased, the voltage of the detection diode 211 corresponding to the same current becomes lower, and the current corresponding to the same voltage becomes larger. Therefore, the detection circuit 240 may further obtain the internal temperature of the drive chip 210 where the detection diode 211 is located based on the voltage across the detection diode 211 and the current flowing through the detection diode 211.

The control circuit 250 is configured to control the drive chip 210 based on the internal temperature of the drive chip 210 obtained by the detection circuit 240. When the detection circuit 240 detects that the internal temperature of the drive chip 210 is greater than a maximum threshold temperature or less than a minimum threshold temperature, the control circuit 250 controls the drive chip 210 to stop outputting the drive signal and continues to output the drive signal until the drive circuit is restarted and the temperature of the drive chip 210 is normal.

The maximum threshold temperature here is a maximum temperature when the drive chip 210 works normally, and the minimum threshold temperature is a minimum temperature when the drive chip 210 works normally. The maximum threshold temperature and the minimum threshold temperature may be determined based on actual chip performance.

Therefore, the drive chip 210 of the drive circuit 200 of the present embodiment outputs the drive signal only when the temperature is normal, and thus the drive chip 210 can be effectively protected to prevent the drive chip 210 from being damaged or burned due to a temperature abnormality.

In the embodiment of the present application, in order to improve integration, the detection circuit 240 and the control circuit 250 may be integrated in the timing controller 260. Of course, one or both of the detection circuit 240 and the control circuit 250 may also be located at another position, which is not limited in the present application.

In an embodiment, the drive circuit 200 further includes a detection resistor 270 connected in series with the detection diode 211. The resistance value of the detection resistor 270 is constant, that is, the detection resistor 270 is a constant resistance, and therefore the current flowing therethrough can be easily obtained by the ratio of the voltage to the resistance. Since the detection diode 211 and the detection resistor 270 are connected in series, the current flowing through the detection resistor 270 is the same as the current flowing through the detection diode.

The acquisition circuit 230 of the present embodiment acquires the voltage across the detection resistor 270 (i.e. acquiring an electrical signal related to the current flowing through the detection diode 211), so that the current flowing through the detection diode 211 can be conveniently obtained.

In an embodiment, on the basis of the above embodiment, further, the acquisition circuit 230 is configured to include a first acquisition sub-circuit 231 and a second acquisition sub-circuit 232. The first acquisition sub-circuit 231 is configured to acquire and output the voltage across the detection diode 211 (i.e. acquiring an electrical signal related to the voltage across the detection diode 211). The second acquisition sub-circuit 232 is configured to acquire and output the voltage across the detection resistor 270 (i.e. acquiring an electrical signal related to the current flowing through the detection diode 211).

The detection circuit 240 calculates the current flowing through the detection diode 211 based on the voltage across the detection resistor 270, and obtains the internal temperature of the drive chip 210 based on the voltage across the detection diode 211 and the current flowing through the detection diode 211.

In this embodiment, the voltage across the detection diode 211 and the voltage across the detection resistor 270 are respectively acquired by the first acquisition sub-circuit 231 and the second acquisition sub-circuit 232, so that the detection circuit 240 can conveniently obtain the voltage across the detection diode 211 and the current flowing through the detection diode 211.

Of course, the embodiment of the present application is not limited thereto. For example, the acquisition circuit 230 may also include only one acquisition sub-circuit, which is only configured to acquire the voltage across one of the detection diode 211 and the detection resistor 270. In this case, the detection circuit 240 may obtain the voltage across another of the detection diode 211 and the detection resistor 270 by subtracting the voltage value acquired by the acquisition circuit 230 from the voltage value of the power supply circuit 220. Therefore, the voltage acquired by the acquisition circuit 230 is an electrical signal related to both the voltage across the detection diode 211 and the current flowing through the detection diode 211 at the same time.

Specifically, the first acquisition sub-circuit 231 may include a first operational amplifier OP1, a first resistor R1, a second resistor R2, a third resistor R3, and a fourth resistor R4. Resistance values of the first resistor R1 and the second resistor R2 are the same, and resistance values of the third resistor R3 and the fourth resistor R4 are the same. Resistance values of the first resistor R1, the second resistor R2, the third resistor R3 and the fourth resistor R4 are all constant, that is, all of the first resistor R1, the second resistor R2, the third resistor R3 and the fourth resistor R4 are constant resistors.

An input end of the first resistor R1 is connected to an input end of the detection diode 211, and an output end of the first resistor R1 is connected to a positive polarity input end of the first operational amplifier OP1 and an input end of the second resistor R2. An output end of the second resistor R2 is grounded (the potential is zero). Hence, positive polarity input end potential $V_1+$ of the first operational amplifier OP1 is obtained by dividing the input end potential V1 of the detection diode 211 by two resistors (the first resistor R1 and the second resistor R2). Since the resistance value of the two resistors are the same, thus $V_1+=(V1)/2$.

An input end of the third resistor R3 is connected to an output end of the detection diode 211, and an output end of the R3 is connected to a negative polarity input end of the first operational amplifier OP1 and an input end of the fourth resistor R4. An output end of the fourth resistor R4 is connected to an output end of the first operational amplifier OP1. Hence, negative polarity input end potential $V_1-$ of the first operational amplifier OP1 can be obtained by detecting output end potential V2 of the detection diode 211 and output end potential VOUT1 of the first operational amplifier OP1, that is, $V_1-=V2-(V2-VOUT1)/2=(V2+VOUT1)/2$.

According to a characteristic of the operational amplifier OP, $V_1+=V_1-$. Thus, $(V1)/2=(V2+VOUT1)/2$, that is, $V1=V2+VOUT1$, and finally $VOUT1=V1-V2$. Hence, the output end potential VOUT1 of the first operational amplifier OP1 is a potential difference between V1 and V2, that is, the voltage across the detection diode 211.

The second acquisition sub-circuit 232 may include a second operational amplifier OP2, a fifth resistor R5, a sixth resistor R6, a seventh resistor R7, and an eighth resistor R8. Resistance values of the fifth resistor R5 and the sixth resistor R6 are the same, and resistance values of the seventh resistor R7 and eighth resistor R8 are the same. Resistance values of the fifth resistor R5, the sixth resistor R6, the seventh resistor R7 and the eighth resistor R8 are all constant, that is, all of the fifth resistor R5, the sixth resistor R6, the seventh resistor R7 and the eighth resistor R8 are constant resistors.

An input end of the fifth resistor R5 is connected to an input end of the detection resistor 270 (i.e. the output end of the detection diode 211). The output end of the fifth resistor R5 is connected to a positive polarity input end of the second operational amplifier OP2 and an input end of the sixth resistor R6. An output end of the sixth resistor R6 is grounded (the potential is zero). Hence, positive polarity input end potential $V_2+$ of the second operational amplifier OP2 is obtained by dividing the input end potential V2 of the detection resistor 270 (i.e. the output end potential V1 of the detection diode 211) by two resistors (the fifth resistor R5 and the sixth resistor R6). Since the resistance value of the two resistors are the same, thus $V_2+=(V2)/2$.

An input end of the seventh resistor R7 is connected to an output end of the detection resistor 270, the output end of the seventh resistor R7 is connected to a negative polarity input end of the second operational amplifier OP2 and an input end of the eighth resistor R8. An output end of the eighth resistor R8 is connected to an output end of the second operational amplifier OP2. Hence, negative polarity input end potential $V_2-$ of the second operational amplifier OP2 can be obtained by detecting output end potential V3 of the detection resistor 270 and output end potential VOUT2 of the second operational amplifier OP2, that is, $V_2-=V3-(V3-VOUT2)/2=(V3+VOUT2)/2$.

According to the characteristic of the operational amplifier OP, $V_2+=V_2-$. Thus, $(V2)/2=(V3+VOUT2)/2$, that is, $V2=V3+VOUT2$, and finally $VOUT2=V2-V3$. Hence, the output end potential VOUT2 of the second operational amplifier OP2 is the potential difference between V2 and V3, that is, the voltage across the detection resistor 270.

The acquisition circuit 230 transmits the VOUT1 and the VOUT2 directly to the detection circuit 240. The detection circuit 240 thus obtains the voltage across the detection diode 211 and the current flowing through the detection circuit 240, thereby obtaining the internal temperature of the drive chip 210.

Of course, in the embodiment of the present application, the specific circuit structure of the first acquisition sub-circuit 231 or the second acquisition sub-circuit 232 of the acquisition circuit 230 may also be different from the above, which is not limited in the present application.

Figure 4:
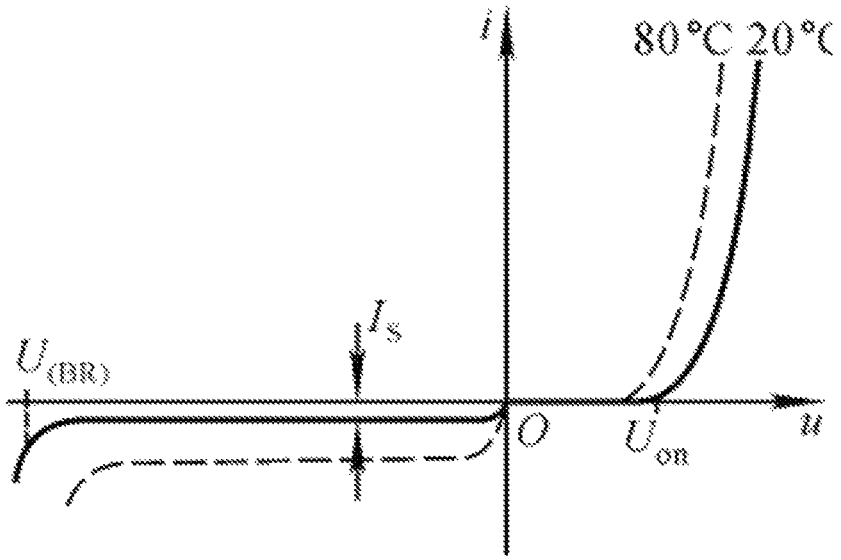
FIG. 4 is a schematic diagram of a current-voltage curve of a detection diode according to an embodiment.

In an embodiment, the feature that "the detection circuit 240 obtains the internal temperature of the drive chip 210 where the detection diode 211 is located based on the voltage across the detection diode 211 and the current flowing through the detection diode 211" specifically includes the followings. The detection circuit 240 obtains the current-voltage curve of the detection diode 211 based on the voltage across the detection diode 211 and the current flowing through the detection diode 211. The internal temperature of the drive chip 210 is obtained based on the current-voltage curve of the detection diode 211. At this time, the detection circuit 240 has a function of automatically analyzing and recognizing the current-voltage curve. For example, referring to FIG. 4, when the curve moves left under a forward voltage, the voltage corresponding to the same current becomes lower, and the current corresponding to the same voltage becomes larger, indicating that the internal temperature of the drive chip 210 where the detection diode 211 is located increases. The internal temperature of the drive chip 210 can be obtained more accurately by means of the current-voltage curve.

Of course, the present application is not limited thereto. For example, in another embodiment, the detection circuit 240 may also include a storage table storing a relationship among the voltage, the current and the temperature, so that the detection circuit 240 may directly obtain the internal temperature of the drive chip 210 where the detection diode 211 is located based on the voltage across the detection diode 211 and the current flowing through the detection diode 211.

In an embodiment, referring to FIG. 3, the drive circuit 200 includes a drive chip 210, a power supply circuit 220, a detection resistor 270, an acquisition circuit 230, and a timing controller 260. The drive chip 210 is configured to provide a drive signal and includes a detection diode 211. The power circuit 220 is configured to provide a constant power supply for the detection diode 211. The resistance value of the detection resistor 270 is constant and is connected in series with the detection diode 211.

The acquisition circuit 230 includes a first acquisition sub-circuit 231 and a second acquisition sub-circuit 232. The first acquisition sub-circuit 231 is configured to acquire and output the voltage across the detection diode 211. The second acquisition sub-circuit 232 is configured to acquire and output the voltage across the detection resistor 270.

The timing controller 260 includes a detection circuit 240 and a control circuit 250. The detection circuit 240 calculates the current flowing through the detection diode 211 based on the voltage across the detection resistor 270, and obtains the internal temperature of the drive chip 210 based on the voltage across the detection diode 211 and the current flowing through the detection diode 211. The control circuit 250 is configured to control the drive chip 210 based on the internal temperature of the drive chip 210 obtained by the detection circuit 240.

When the detection circuit 230 detects that the internal temperature of the drive chip 210 is greater than the maximum threshold temperature or less than the minimum threshold temperature, the control circuit 250 controls the drive chip 210 to stop outputting the drive signal and continues to output the drive signal until the drive circuit is restarted and the temperature of the drive chip 210 is normal.

The maximum threshold temperature here is the maximum temperature when the drive chip 210 works normally, and the minimum threshold temperature is the minimum temperature when the drive chip 210 works normally. The maximum threshold temperature and the minimum threshold temperature may be determined based on the actual chip performance.

Therefore, the drive chip 210 of the drive circuit 200 of the present embodiment outputs the drive signal only when the temperature is normal, and thus the drive chip 210 can be effectively protected to prevent the drive chip 210 from being damaged or burned due to the temperature abnormality.

The circuits and sub-circuits in the present disclosure may have other implementation forms. For example, the circuits and sub-circuits may be, but are not limited to, an application-specific integrated circuit (ASIC) chip, a field-programmable gate array (FPGA), a dedicated or shared processor that executes a particular software module or a piece of code at a particular time, and/or other programmable-logic devices now known or later developed.

The respective technical features of the above embodiments can be combined arbitrarily, and in order to brief the description, all possible combinations of the respective technical features in the above embodiments are not described; however, as long as the combination of these technical features does not have any contradiction, it should be considered to be the scope of disclosure disclosed in the present description.

The above embodiments merely express several embodiments of the present application, and the description thereof is more specific and detailed, but cannot be construed as limiting the scope of the present invention. It should be noted that, for a person of ordinary skill in the art, several modifications and improvements can also be made without departing from the concept of the present application, which all belong to the scope of protection of the present application. Therefore, the scope of protection of the present application should be regarded by the appended claims.

What is claimed is:

1. A drive circuit, comprising:

a drive chip, configured to provide a drive signal, comprising a detection diode;

a power supply circuit, configured to provide a constant power supply for the detection diode;

an acquisition circuit, configured to acquire an electrical signal related to a voltage across the detection diode and a current flowing through the detection diode;

a detection circuit, configured to obtain the voltage across the detection diode and the current flowing through the detection diode based on the electrical signal acquired by the acquisition circuit, and obtain an internal temperature of the drive chip based on the voltage across the detection diode and the current flowing through the detection diode; and a control circuit, configured to control the drive chip based on the internal temperature of the drive chip obtained by the detection circuit;

a detection resistor connected in series with the detection diode, wherein a resistance value of the detection resistor is constant, and the acquisition circuit is configured to acquire a voltage across the detection resistor;

wherein the acquisition circuit comprises a first acquisition sub-circuit and a second acquisition sub-circuit;

the first acquisition sub-circuit is configured to acquire and output the voltage across the detection diode, and the second acquisition sub-circuit is configured to acquire and output the voltage across the detection resistor; and the detection circuit is further configured to calculate the current flowing through the detection diode based on the voltage across the detection resistor, and to obtain the internal temperature of the drive chip based on the voltage across the detection diode and the current flowing through the detection diode; and wherein when the detection circuit detects that the internal temperature of the drive chip is greater than a maximum threshold temperature or less than a minimum threshold temperature, the control circuit controls the drive chip to stop outputting the drive signal.

2. The drive circuit according to claim 1, wherein the acquisition circuit is configured to acquire the voltage across the detection diode.

3. The drive circuit according to claim 1, wherein the acquisition circuit is configured to acquire the voltage across the detection diode and the current flowing through the detection diode.

4. The drive circuit according to claim 1, wherein the maximum threshold temperature and the minimum threshold temperature are determined based on performance of the drive chip.

5. The drive circuit according to claim 1, wherein the first acquisition sub-circuit comprises a first operational amplifier, a first resistor, a second resistor, a third resistor and a fourth resistor;

resistance values of the first resistor and the second resistor are the same and are constant, and resistance values of the third resistor and the fourth resistor are the same and are constant;

an input end of the first resistor is connected to an input end of the detection diode, an output end of the first resistor is connected to a positive polarity input end of the first operational amplifier and an input end of the second resistor, and an output end of the second resistor is grounded;

an input end of the third resistor is connected to an output end of the detection diode, an output end of the R3 is connected to a negative polarity input end of the first operational amplifier and an input end of the fourth resistor, and an output end of the fourth resistor is connected to an output end of the first operational amplifier.

6. The drive circuit according to claim 5, wherein the first acquisition sub-circuit is further configured to acquire and output an output end potential of the first operational amplifier.

7. The drive circuit according to claim 1, wherein the second acquisition sub-circuit comprises a second operational amplifier, a fifth resistor, a sixth resistor, a seventh resistor and an eighth resistor;

resistance values of the fifth resistor and the sixth resistor are the same and are constant, and resistance values of the seventh resistor and the eighth resistor are the same resistance and are constant;

an input end of the fifth resistor is connected to an input end of the detection resistor, an output end of the fifth resistor is connected to a positive polarity input end of the second operational amplifier and an input end of the sixth resistor, and an output end of the sixth resistor is grounded;

an input end of the seventh resistor is connected to an output end of the detection resistor, an output end of the seventh resistor is connected to a negative polarity input end of the second operational amplifier and an input end of the eighth resistor, and an output end of the eighth resistor is connected to an output end of the second operational amplifier.

8. The drive circuit according to claim 7, wherein the second acquisition sub-circuit is further configured to acquire and output an output end potential of the second operational amplifier.

9. The drive circuit according to claim 1, wherein the detection circuit is further configured to obtain a current-voltage curve of the detection diode based on the voltage across the detection diode and the current flowing through the detection diode, and to obtain the internal temperature of the drive chip based on the current-voltage curve of the detection diode.

10. The drive circuit according to claim 9, wherein the detection circuit is provided with a function of automatically analyzing and recognizing the current-voltage curve.

11. The drive circuit according to claim 1, wherein the detection circuit comprises a storage table storing a relationship between the electrical signal related to the voltage across the detection diode and the current flowing through the detection diode and the internal temperature of the drive chip; and the detection circuit is further configured to obtain the internal temperature of the drive chip based on the storage table.

12. The drive circuit according to claim 1, wherein the drive circuit further comprises a timing controller;

the timing controller is configured to control an output timing of the drive signal, and the detection circuit and the control circuit are located in the timing controller.

13. The drive circuit according to claim 1, wherein the drive chip is a gate driver and/or a data driver.

14. A drive circuit, comprising:

a drive chip, configured to provide a drive signal, comprising a detection diode;

a power supply circuit, configured to provide a constant power supply for the detection diode;

a detection resistor, having a constant resistance value and being connected in series with the detection diode;

an acquisition circuit, comprising a first acquisition sub-circuit and a second acquisition sub-circuit, the first acquisition sub-circuit being configured to acquire and output a voltage across the detection diode, and the second acquisition sub-circuit being configured to acquire and output a voltage across the detection resistor;

a timing controller, comprising a detection circuit and a control circuit, wherein the detection circuit is configured to calculate a current flowing through the detection diode based on the voltage across the detection resistor, and to obtain an internal temperature of the drive chip based on the voltage across the detection diode and the current flowing through the detection diode; and a control circuit, configured to control the drive chip based on the internal temperature of the drive chip obtained by the detection circuit; when the detection circuit detects that the internal temperature of the drive chip is greater than a maximum threshold temperature or less than a minimum threshold temperature, the control circuit controls the drive chip to stop outputting the drive signal.

15. The drive circuit according to claim 14, wherein the maximum threshold temperature and the minimum threshold temperature are determined based on performance of the drive chip.

16. The drive circuit according to claim 14, wherein the detection circuit is further configured to obtain a current-voltage curve of the detection diode based on the voltage across the detection diode and the current flowing through the detection diode, and to obtain the internal temperature of the drive chip based on the current-voltage curve of the detection diode.

17. The drive circuit according to claim 14, wherein the detection circuit comprises a storage table storing a relationship between the electrical signal related to the voltage across the detection diode and the current flowing through the detection diode and the internal temperature of the drive chip; and the detection circuit is further configured to obtain the internal temperature of the drive chip based on the storage table.

18. A display device, comprising a display panel, and the drive circuit of claim 1, wherein the drive circuit is configured to drive the display panel.

* * * * *